United States Patent [19]

Strauch

[11] Patent Number: 4,809,605

[45] Date of Patent: Mar. 7, 1989

[54] APPARATUS FOR PRINTING ON MATERIAL IN WEB FORM

[75] Inventor: Karl Strauch, Kirchlengern, Fed. Rep. of Germany

[73] Assignee: Werner Kammann Maschinenfabrik GmbH, Bunde, Fed. Rep. of Germany

[21] Appl. No.: 149,263

[22] Filed: Jan. 28, 1988

[30] Foreign Application Priority Data

Nov. 16, 1987 [DE] Fed. Rep. of Germany ..... 3738836

[51] Int. Cl.[4] ..... B05C 17/04

[52] U.S. Cl. ..... 101/123; 101/129

[58] Field of Search ..... 101/129, 114, 115, 116, 101/118–120, 123, 126, 127; 118/301

[56] References Cited

U.S. PATENT DOCUMENTS

| | | | |
|---|---|---|---|
| 2,623,456 | 12/1952 | McCormick et al. | 101/123 |
| 2,991,711 | 7/1961 | Ehrhard et al. | 101/123 |
| 3,101,665 | 8/1963 | Hall | 101/123 |
| 4,063,502 | 12/1977 | Cunningham | 101/123 |
| 4,245,554 | 1/1981 | Kamnann et al. | 101/123 |
| 4,352,326 | 10/1982 | Kammann | 101/123 |
| 4,493,254 | 1/1985 | Landesman et al. | 101/123 |
| 4,520,726 | 6/1985 | Rouly et al. | 101/123 |
| 4,589,336 | 5/1986 | Klemm | 101/123 |
| 4,628,814 | 12/1986 | Klemm | 101/123 |
| 4,696,228 | 9/1987 | David et al. | 101/123 |

*Primary Examiner*—Eugene H. Eickholt

*Attorney, Agent, or Firm*—Seidel, Gonda, Lavorgna & Monaco

[57] ABSTRACT

In printing an image on a web of material by a screen printing operation, the screen printing stencil is arranged at an acute angle relative to the path of movement of an impression cylinder operable to press the web of material against the stencil. During the printing operation the stencil is lifted approximately perpendicularly to the line of the path of movement of the impression cylinder and is simultaneously displaced parallel to its own main plane over a distance whose length depends on the angle of inclination of the stencil relative to the path of movement of the impression cylinder. In order to adapt the length of the print image on the stencil to a predetermined length on the web of material on which an image is to be printed, the extent of the parallel displacement of the stencil may be varied in accordance with the difference between the length of the print image on the stencil and the predetermined length for the image to be applied on the web of material.

6 Claims, 2 Drawing Sheets

14
18
36
28
12
10
48
16
26
36
20
42
20
23
15
11
38
40
22
21
19
32
22
17
30
24
44
50
46

10
14
18
28
11
20
42
16
26
40
20
15
17
28
38
19
22
22
24
50

30'
30''
11
34
30

APPARATUS FOR PRINTING ON MATERIAL IN WEB FORM

BACKGROUND OF THE INVENTION

There are various forms of process and apparatus for printing on material in web form using a screen printing stencil. In such processes, it is advantageous for the web of material to be moved away from the screen printing stencil at an acute angle directly after the printing ink has been applied to the material. The resulting rapid separation of the screen printing stencil and the printed web of material has the effect of enhancing the quality of the printed image on the material. If the support or impression cylinder for supporting the material during the printing operation is displaced relative to the web of material as printing takes place, it is necessary that the portion of the web of material, which passes into the printing mechanism on to the impression cylinder by way of a guide roller, and the portion of the web of material which moves away from the impression cylinder as the material leaves the printing mechanism, with the web of material passing around the impression cylinder over a part of the periphery thereof, extend parallel to each other at least in the region within which the impression cylinder is displaced during the printing operation, and that the printing mechanism which comprises a squeegee and impression cylinder as well as a guide roller is moved during the printing operation parallel to the portion of the web of material on which the printing is produced during the printing operation. That operating procedure takes account of the fact that, in the event of defective parallelism between the movement of the impression cylinder during the printing operation and the path of movement of the portions of the web of material which are adjacent to the printing mechanism, displacement of the impression cylinder would result in a change in the relative speeds as between the screen printing stencil and the web of material, which would have an adverse effect on the quality of the printed image. For that reason the movement of the impression cylinder and the movement of the associated guide roller are parallel to the path of movement of the web of material between the guide elements which guide the material upstream and downstream of the printing mechanism.

When the screen printing stencil is arranged in a horizontal position, then under the above-indicated conditions the web of material must be introduced into the printing mechanism from above and discharged therefrom again in a downward direction, as is the case for example with the process disclosed in European patent specification No. 0 003 983 and U.S. Pat. No. 4,425,554. However it is not always possible for the web of material to be guided in that way in the printing station because for that purpose there must be a suitable amount of space in the area beneath the printing station, for the web of material to be passed therethrough. When using a screen printing stencil which is of considerable length in the printing direction, it is also difficult for the material to be fed into the printing mechanism at an inclined angle from above as in that situation the screen printing stencil tends to be in the way.

When dealing with a multiple printing process, for example when producing a printed image which is made up of a plurality of different colours or inks, a plurality of individual printed images have to be successively applied to the web of material. In many cases, once such an individual printed image has been applied to the web of material, that image has to be dried by the application of heat thereto before the next individual printed image can be applied to the material. In that case it is frequently necessary for the web of material to be passed through the screen printing machine two or more times. If for example the printed image to be produced on the web of material is made up of six colours and the machine comprises three printing stations, then in a single pass through the machine, three individual printed images of different colours can be successively applied to the material. The three further printed images which are necessary in order to complete the finished image, of different colours, are then applied in a second pass through the machine, using screen printing stencils carrying the printed images associated with the respective inks in question.

An important condition for producing a satisfactory printed image which meets all reasonable requirements in respect of quality is that the individual components which make up the finished printed image, that is to say the individual printed images as referred to above, which are each applied using a screen printing stencil, are in precise registry with each other. Meeting that requirement does not give rise to any particular difficulty at any event when the web to which the printing is to be applied does not experience a change in its dimensions between the individual printing operations as, when using the technical equipment which is available nowadays, the web on which the printing is to be produced can be aligned relative to the individual screen printing stencils with such a degree of accuracy that the contours of the individual printed images precisely register with each other and are therefore congruent. However it is entirely possible and even probable when the web to which the printing is to be applied consists of certain materials that between the individual printing operations the web of material may undergo a change in length, for example it may shrink or stretch somewhat in its longitudinal direction. That may be caused for example due to the application of heat for the purposes of drying the printing ink between the individual printing operations, or by virtue of the moisture which is applied with the printing ink to the web of material in the printing operations. However such changes in length may also be caused by the moisture content of the ambient atmosphere, in particular when the web of material has to be put into intermediate storage over a prolonged period of time, which may be for example up to several days, for the purposes of applying a corresponding number of individual printed images which therefore go to make up the finished printed image, between two or more passes of the material through the printing apparatus. Intermediate storage in that situation is practically inevitable as the second and possibly further passes through the machine normally require the use of different screen printing stencils so that for reasons of economy the obvious procedure to be adopted involves firstly applying to all the web of material the initial individual printed images which are to be produced in the first pass through the equipment, and then, after suitable conversion of the machine and the fitting thereof with the appropriate different stencils, applying the remaining individual printed images to the entire web of material.

It may be appreciated that the extent of the changes in length which are caused by the above-indicated factors and in particular moisture is normally very slight and may be for example of the order of magnitude of 0.1 to 1.0 mm per 1000 mm of length of web. However, even such minor deviations can no longer be tolerated with the requirements which are now made on a screen printing process, in regard to the degree of accuracy which is to be observed therewith, so that it is necessary for the individual printed images which are to be successively applied to the web of material to be accurately matched to each other in regard to the length thereof, with the individual printed image which is applied in a first working operation generally defining the desired or reference length for all printed images which are to be subsequently applied. The high levels of requirement in respect of accuracy with which the individual printed images are applied to the web of material arise out of the fact that in many cases those printed images are later cut out of the web of material, for example by a stamping operation. If the individual printed images which go to make up the finished image are of different lengths, then, when the printed image is cut out of the web of material, either a narrow strip is cut off a printed image which is of excessive length or, in the case of a printed image which is too short, a narrow strip of material which does not have any printing thereon is not cut off, and thus becomes a part of the finished printed image. It will be readily appreciated that that is unacceptable in many situations. A typical example in that respect are printed circuits although the above-described problem is in no way limited thereto but also arises in connection with printed images which are used in different ways and for different purposes, for example as labels.

It would be theoretically possible, by suitably adjusting the tension of the web of material, to match the length of the web of material and therewith the individual printed image which has already been produced thereon to the reference length which is defined by the length of the image carried by the screen printing stencil, in the respective subsequent pass through the machine, by subjecting the web of material to an appropriate longitudinally acting force which therefore stretches the material to the appropriate length. In practice however that tends to involve very serious difficulties as for example the modulus of elasticity of the material of the web may vary over the length of the web. Added to that is the fact that adjusting the printed image by suitably stretching the web of material as indicated above will normally only over provide for an increase in the length of an individual printed image which is already on the web of material and which has turned out to be too short due to the effect of the above-mentioned factors such as moisture and the like. It will be appreciated that it would be theoretically possible for the web to be pre-stressed and thus increased in length in the first pass through the printing machine so that, in subsequent passes, the length of the web and therewith also the individual printed images already produced thereon could be reduced by reducing the level of stretching of the web. However that would make the entire procedure even more complicated so that in practice it could only be carried into effect, if at all, at a very high level of expenditure.

It will also be appreciated that the web of material may experience a change in its dimension which is transverse to its longitudinal direction, that is to say its width, under the effect of the above-mentioned factors which tend to influence the web of material. However that change is negligible in view of the fact that the width of the web is very small in relation to its longitudinal extent, especially as the extent or the dimension of the printed image in the transverse direction of the web of material is normally considerably shorter than in the longitudinal direction of the web.

SUMMARY OF THE INVENTION

An object of the present invention is to provide a process and an apparatus for printing on a web of material, which provides for an easier operating procedure than hitherto in the printing operation and in the feed of material thereto.

Another object of the invention is to provide a process for printing on a web of material, which provides for better control of the length of the image to be printed on the web of material from a stencil.

Still another object of the present invention is to provide a process for printing on a web of material using a screen printing stencil, which can provide for better image reproduction and register thereof.

Yet another object of the invention is to provide an apparatus for printing on a web of material by means of a screen printing stencil, wherein the material can be supplied to the printing mechanism in a convenient fashion without the requirement for additional space for movement of the web of material in the region below the stencil.

A further object of the invention is to provide a screen printing machine in which the layout is such that the material to be printed upon can be readily fed to the printing mechanism in an uncomplicated fashion.

Still a further object of the present invention is to provide a screen printing apparatus in which the length of the printed image to be applied to a web of material can be readily adapted to a predetermined length without involving major apparatus expenditure.

In accordance with the present invention, these and other objects are achieved by a process for printing on material in web form using at least one screen printing stencil with at least one squeegee and a support or impression cylinder co-operating therewith. During the printing operation the impression cylinder is displaced along a distance over which the screen printing stencil extends at an acute angle so that there is a difference in length between the printed image which is carried by the screen printing stencil and the projection thereof on to the path over which the impression cylinder moves. During the printing operation the screen printing stencil is displaced relative to the impression cylinder substantially perpendicularly to the line of the path of movement of the cylinder and simultaneously in the printing direction substantially parallel to the plane thereof, by a distance whose extent corresponds to the difference between the image carried by the stencil and the projection thereof on to the path of movement of the impression cylinder.

That mode of operation provides that the portions of the web of material which are adjacent to the respective printing mechanism can extend in a direction which can be selected in dependence on the operating conditions involved, as laid down from the point of view of the printing process and the machine design. Generally the portions of the web of material which are adjacent to the printing mechanism will extend horizontally as that provides for a particularly advantageous arrangement of the co-operating components in a screen printing machine having two or more printing stations. The fact that the screen printing stencil is displaced parallel to its main plane during the printing operation compensates for the difference between the length of the image carried by the screen printing stencil on the one hand and the length of the projection of that image on to the path of movement of the impression cylinder and the squeegee during the printing stroke movement thereof.

In accordance with a preferred feature of the invention, the operating procedure may provide that the extent of the displacement of the screen printing stencil, which is substantially parallel to its plane, is selected to adapt the length of the print image to be applied to the web of material using the screen printing stencil, to the length which is predetermined on the web of material therefor, corresponding to the difference between the length of the image carried by the screen printing stencil and the length which is provided on the web of material for the image to be applied thereto, so that the extent of the parallel displacement deviates from the normal extent which is used when solely taking account of the difference between the print image carried by the stencil and the projection thereof on to the path of movement of the impression cylinder.

In comparison with the normal extent of the parallel displacement which only compensates for a difference in length between the print image carried by the screen printing stencil and the length of the projection thereof on to the path of movement over which the impression cylinder is displaced during the printing operation, the extent of the parallel displacement referred to above is therefore increased if the dimension of the printed image which is predetermined on the web of material in the longitudinal direction thereof is greater than the corresponding dimension of the image carried by the screen printing stencil. Conversely, the extent of the parallel displacement of the screen printing stencil is reduced if the dimension of the image to be applied to the web of material, in the longitudinal direction thereof, is shorter than the length of the image carried by the stencil. In a limit situation, it is even possible for the parallel displacement of the stencil to be in the opposite direction, that is to say opposite to the printing direction. It should be appreciated however that that will only be necessary when the difference of the length set for the printed image on the web of material on the one hand and the length of the image of the screen printing stencil on the other hand is very substantial and the angle of inclination between the stencil and the line of the path of movement of the impression cylinder is comparatively slight.

In accordance with a further feature of the invention, it is possible for the impression cylinder to be displaced by a distance which is equal to the length of the image carried by the screen printing stencil. It should be noted that that is not absolutely necessary so that there is also no need for the length of the distance covered by the impression cylinder in the printing operation to be correspondingly adapted in the event of a change in the length of the image to be applied to the material, as long as the stroke movement performed by the impression cylinder is of sufficient length.

In regard to apparatus, the foregoing and other objects of the invention are achieved by an apparatus for printing on material in web form by means of at least one screen printing stencil with at least one squeegee and a support or impression cylinder which co-operates therewith and which, during the operation of applying the printed image to the material, is moved relative to the stencil by a distance in the direction of printing, that is to say in the longitudinal direction of the web of material. The screen printing stencil is arranged at an acute angle relative to the path of movement of the impression cylinder, while there is a difference in length between the print image carried by the stencil and the projection thereof on to the path of movement of the impression cylinder. During the printing operation the stencil is moved relative to the impression cylinder along a guide means substantially perpendicularly to the path of movement of the impression cylinder and is longitudinally displaced parallel to the plane thereof, the extent of the longitudinal displacement of the stencil corresponding to the difference in length between the image carried by the stencil and the projection thereof on to the path of movement of the impression cylinder.

In accordance with a preferred embodiment of the invention, the guide means along which the stencil is guided during its movement substantially perpendicularly to the line of movement of the impression cylinder is adjustable in order thereby to adapt the length of the printed image applied to the web of material to a length which is predetermined on the web of material, in order thereby to adapt the extent of the parallel displacement of the stencil to the difference between the length of the image carried by the stencil and the length which is predetermined for the image to be applied on the web of material.

Another particularly advantageous embodiment provides that the guide means comprises at least one guide bar or rail which in its normal position includes relative to the vertical an angle which is equal to half the angle by which the stencil is inclined relative to the path of movement of the impression cylinder, and is adapted to be pivotable and fixable in a certain position in a plane which extends parallel to the path of movement of the impression cylinder, said path being perpendicular to the plane of the stencil.

In that respect the normal position is that position of the guide bar or rail in which the printed image to be applied to the web of material is of an extent, in the longitudinal direction of the web, which is equal to the corresponding extent of the image carried by the stencil, so that parallel displacement of the stencil during the printing operation only serves to compensate for the difference in length which occurs by virtue of the inclination of the stencil, between the image carried by the stencil on the one hand and on the other hand the projection thereof on to the path of movement covered by the impression cylinder during the printing operation.

In a more particular embodiment, the frame of the screen printing stencil or any members connected thereto may be provided with at least one group comprising three co-operating rollers which bear against the guide bar or rail and which are carried by a common holding means which is mounted pivotably to the frame of the screen printing stencil or to an extension portion thereof, in a plane which extends perpendicularly to the plane of the stencil and parallel to the path of movement of the impression cylinder. In that way, in the event of a change in the inclined position of the guide bar or rail, the three rollers can automatically adapt to the respective path of the guide bar or rail.

In addition, in another feature of the invention, the impression cylinder may be carried by a reciprocatable carriage provided with a sliding guide means for the screen printing stencil. The sliding guide means, relative to the line of the path of movement of the carriage, includes an angle which is equal to the angle at which the stencil is inclined relative to the path of movement of the carriage. That arrangement of the components involved makes it possible easily to provide for a positive guidance action between the carriage and the impression cylinder on the one hand and the screen printing stencil on the other hand, and in particular also in regard to matching the position of the screen printing stencil in respect of height to the positions occupied by the impression cylinder and therewith the web of material, in the course of the printing operation.

Further objects, features and advantages of the invention will be apparent from the following description of a preferred embodiment thereof.

DESCRIPTION OF THE PREFERRED EMBODIMENT

Figure 1:
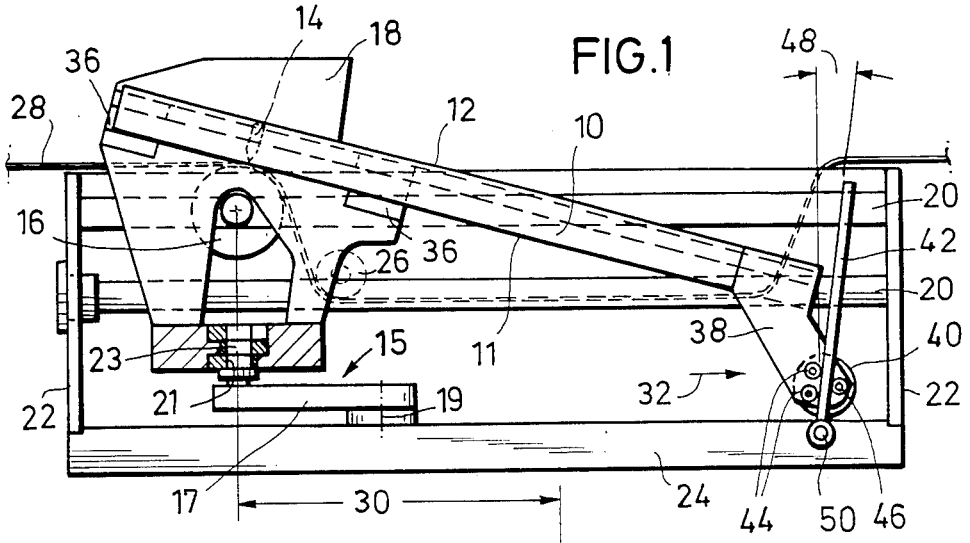
FIG. 1 is a diagrammatic side view of a printing station for printing on a web of material, with the components of the apparatus in their positions at the beginning of a printing stroke movement.
Figure 2:
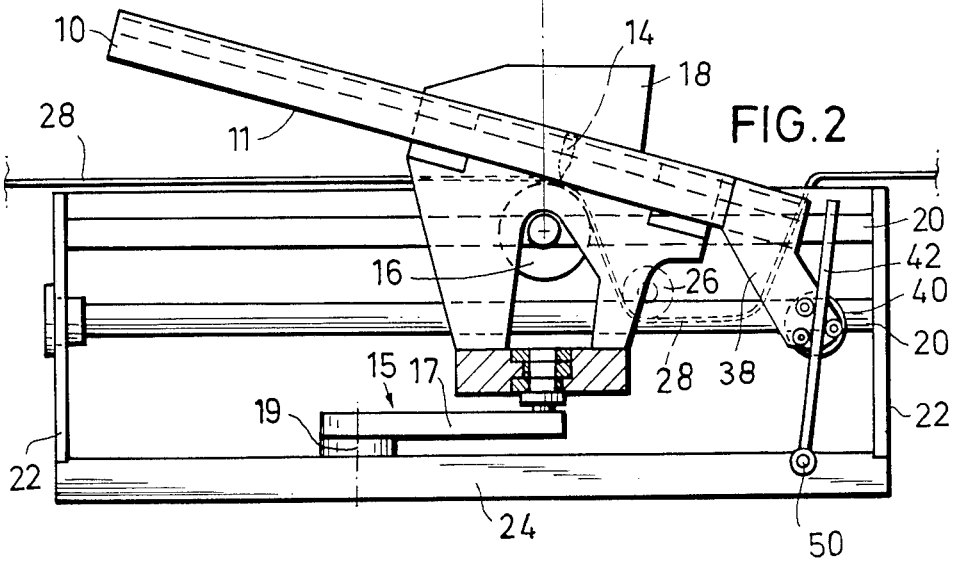
FIG. 2 is a view corresponding to FIG. 1 showing the position of the co-operating components at the end of a printing stroke movement.

Referring firstly to FIGS. 1 and 2, illustrated therein is an apparatus for printing on material in web form, which essentially comprises a screen printing stencil assembly as indicated generally at 10, having a screen printing stencil 11 disposed within a frame 12 and co-operating with a squeegee 14 and a support or impression cylinder 16. The squeegee 14 and the cylinder 16 are carried by a common carriage 18 which is arranged to perform a reciprocating movement in a horizontal plane and which is guided on bar members 20. The bar members 20 are mounted on vertical supports 22 which are connected to the frame structure 24 of the machine. The carriage 18 is driven in its reciprocating movement by way of a crank drive arrangement 15 having a crank 17 which is arranged pivotably about an axis as indicated at 19. The carriage is provided with a horizontal guide slot 21 which extends transversely with respect to the bar members 20 and into which engages a pin member 23 on the crank arm 17.

Associated with the cylinder 16 is a guide roller 26 which is also carried by the carriage 18. The cylinder 16 and the guide roller 26 serve to guide the web of material 28 which is to be printed upon in a portion-wise manner when the web of material 28 is stationary between two transportation stepping movements thereof. The web of material 28 can be drawn from a supply roll and can be re-wound as a roll after the printing operation thereon.

Figure 3:
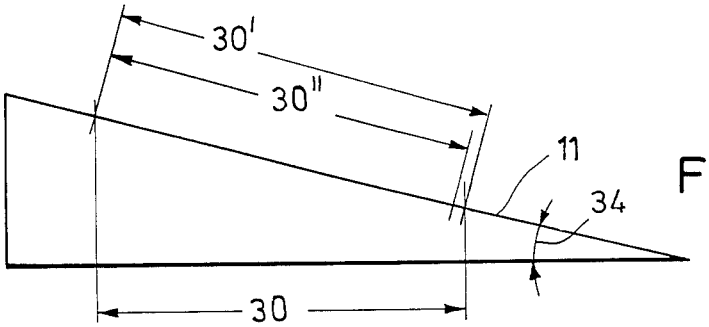
FIG. 3 shows the geometrical relationship between the screen printing stencil and the path of movement of the impression cylinder.

Referring now also to FIG. 3, the screen printing stencil assembly 10 is inclined by an angle 34 in FIG. 3 relative to the horizontal path of movement 30 over which the carriage 18 and therewith the impression cylinder 16 is displaceable during a printing stroke movement, in the direction indicated by the arrow 32 in FIG. 1. The length of the path of movement 30 which is identified as such in FIG. 3 will be clearly apparent from a comparison between FIGS. 1 and 2 which respectively show the carriage 18 and therewith the impression cylinder 16 in a position at the beginning of a stroke movement (FIG. 1) and at the end of its stroke movement (FIG. 2). In the embodiment illustrated in the drawings, the angle 34 is 15°.

The carriage 18 is provided with a sliding guide 36 for the screen printing stencil assembly 10. The sliding guide 36 is also arranged at an angle of 15° to the horizontal, corresponding therefore to the angle 34 relative to the bar members 20 which determine the line of the path of movement over which the carriage 18 is moved with the impression cylinder 16 and the squeegee 14 during the printing stroke movement, in the direction indicated by the arrow 32.

Figure 4:
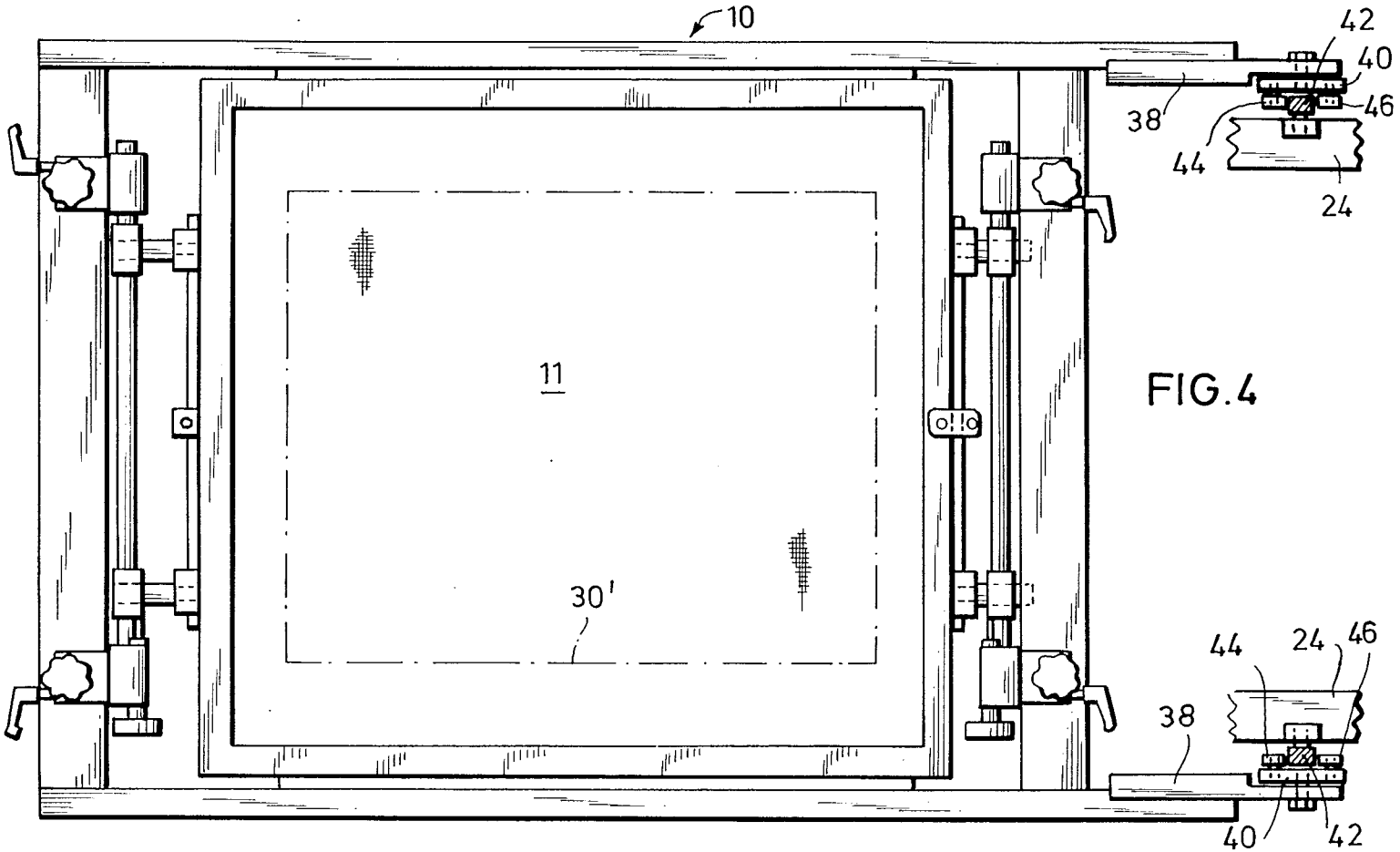
FIG. 4 is a plan view of the screen printing stencil.

The screen printing stencil assembly 10 is also provided at its lower end region, towards the right in FIGS. 1 and 2, with two lateral, downwardly projecting extension portions 38. Each of the extension portions 38 carries a holding means 40 which is mounted to the respective extension portion 38 pivotably about an axis 41 (identified in FIG. 4), in a perpendicular plane which extends parallel to the bar members 20. Each holding means 40 carries three rollers which are arranged relative to each other in the manner shown in FIGS. 1 and 2 and which each co-operate with respective guide bars or rails 42 in such a way that two rollers 44 are disposed at one side thereof while the third roller 46 of each group of rollers is disposed at the other side of the guide bar or rail 42. The rollers 44, 46 bear against the respective guide bar or rail 42 in such a way that the rollers 44 and 46 and therewith the members carrying same can be easily displaced along the respective guide bar or rail 42. As the rollers 44 and 46 are respectively connected by way of holding means 40 and extension portions 38 to the screen printing stencil assembly 10, the guide bars or rails 12 thus represent a means for guiding the screen printing stencil between the positions shown in FIGS. 1 and 2 respectively.

As the screen printing stencil assembly 10 is mounted by the sliding guide means 36 of the carriage 18, displacement of the carriage 18, during the printing stroke movement towards the right in the direction of the arrow 32, results in a relative displacement as between the carriage 18 and the screen printing stencil assembly 10, parallel to the main plane of the screen printing stencil 11, with the latter being displaced upwardly at the same time. In other words, the carriage 18 on the one hand and the screen printing stencil assembly 10 on the other hand are connected together by way of a positive guide means, namely the sliding bearing 36, which ensures that during the printing stroke movement the screen printing stencil 11 is in the correct relative position with respect to the impression cylinder 16 and thus with respect to the web of material 28 to which the printing is to be applied and which is guided over the cylinder 16, as can be clearly seen from FIGS. 1 and 2. During the printing stroke movement the impression cylinder 16 brings the portion of the web of material 28 which is to be printed upon, into contact with the screen printing stencil 10. The squeegee 14 which is also mounted on the carriage 18 thus transfers the printing ink or dye through the printing stencil to produce the printed image on the web of material 28.

Referring again to FIG. 3, the length of the print image 30'' which is carried by the screen printing stencil 11 is equal to the length of the distance 30 by which the impression cylinder 16 is moved during the printing stroke movement. By virtue of the inclined arrangement of the screen printing stencil 11 relative to the line of the movement 30 of the impression cylinder 16, the projection of the image 30″ carried by the screen printing stencil 11 on to the path of movement 30 is shorter. The conditions involved can be clearly seen from FIG. 3 of the drawings showing the geometrical relationships between the path of movement 30 of the impression cylinder 16 and the screen printing stencil 11 or the print image 30″ carried thereby. With an increasing value of the angle 34, the difference between the length of the path of movement 30 and the length, which is projected thereonto, of the image 30″ carried by the stencil 11, increases. Conversely, that difference decreases as the value of the angle 34 diminishes. An arrangement of the screen printing stencil assembly 10 in which the screen printing stencil 11 extends parallel to the path of movement of the impression cylinder 16 during the printing stroke movement is undesirable as the inclined arrangement of the screen printing stencil assembly 10, with the printed portion of the web of material 28 extending substantially horizontally in the course of the printing stroke movement, that is to say the movement of the cylinder 16 in the direction indicated by the arrow 32, causes the web of material 28 to be properly and satisfactorily released and moved away from the screen printing stencil 11 as soon as the web of material 28 which carries the printed image thereon, during the printing stroke movement, leaves the region between the screen printing stencil 11 and the cylinder 16. Furthermore, the inclined positioning of the screen printing stencil assembly 10 provides for satisfactory distribution of the ink or dye over the region of the screen printing stencil 11 on which the printed image has been produced, as well as providing for collection of the ink or dye in the lower region of the stencil, which also contributes to enhancing the quality of printing.

When the angle 34 is 15°, that in many cases represents a kind of optimum as between the above-mentioned requirements obtaining in respect of the printing operation, and the difference in length, as conditioned by the inclination of the screen printing stencil 11 relative to the path of movement 30, between the path of movement 30 and the print image 30″ which is projected on to the path of movement 30 from the stencil 11. That difference in length must be compensated for during the printing operation if the machine is to prevent the printed image which appears on the web of material 28 only being of a length corresponding to the projection of the image 30″ on to the path of movement 30, which would accordingly be shorter than the true length of the image 30″ carried by the screen printing stencil 11. That compensation effect is achieved by virtue of the fact that, in the printing operation, that is to say during the printing stroke movement performed by the impression cylinder 16, the screen printing stencil assembly 10 with the stencil 11 performs a movement parallel to its main plane. That parallel displacement which is superimposed on and is therefore additional to the upward displacement of the stencil assembly 10 which is produced at the same time by the sliding mounting 36, takes place from left to right in the views shown in FIGS. 1 to 3, that is to say substantially in the direction in which the impression cylinder 16 also moves during the printing stroke movement. The parallel displacement of the screen printing stencil 11 is produced by the guide bars or rails 42 which in the normal position, in order to compensate for the above-mentioned difference in length, are inclined relative to the vertical by an angle as indicated at 48 in FIG. 1 in such a way that, in the course of its upward movement along the guide bars or rails 42, the screen printing stencil assembly 10 also experiences a parallel displacement from left to right in FIGS. 1 to 3, which compensates for the difference between the length of the image 30″ provided by the screen printing stencil and the projection of that image on to the horizontal, that is to say the path of movement 30.

FIG. 3 shows that, at the beginning of a printing operation, the screen printing stencil 11 occupies a position in which the lefthand of the print image 30″ thereof is at the starting point of the stroke movement which is performed by the impression cylinder 16 along the path 30 during the printing operation. In that position the image 30″ terminates short of the end of the path of movement 30. By virtue of the displacement of the screen printing stencil assembly 10 towards the right however, the right-hand end of the image 30″ carried by the screen printing stencil 11 is to be found at the end of the stroke movement and also at the end of the path of movement 30 of the impression cylinder 16. The distance 30′ which extends parallel to the screen printing stencil 11 in FIG. 3 identifies the spacing between the left-hand end of the image 30″ carried by the screen printing stencil 11 at the beginning of the printing operation on the one hand, that is to say prior to the commencement of the parallel displacement of the screen printing stencil 11 towards the right in FIGS. 1 to 3, and the right-hand end of the image 30″ at the end of the printing stroke movement, that is to say after termination of the parallel displacement of the stencil 11 towards the right in the course of the printing stroke movement performed by the impression cylinder 16.

In that connection, in order to provide the above-described compensation effect, the angle of inclination 48 of the guide bars or rails 42 must correspond in each case to half the value of the angle 34 by which the screen printing stencil assembly 10 is inclined relative to the path of movement 30 or the bar members 20 along which the carriage 18 with the impression cylinder 16 is movable. Accordingly, when the angle 34 is 15°, the angle 48 is 7.5°.

The guide bars or rails 42 are mounted on the screen printing machine pivotably about an axis as indicated at 50 which is disposed adjacent the lower end of the respective guide rail or bar 42, the pivotal movement occurring in a vertical plane extending parallel to the path of movement 30. Thus the angle 48 which is included between the guide bars or rails 42 and the vertical can be altered by suitable pivotal movement thereof. That is desirable and possibly even necessary if the length 30″ of the image carried by the screen printing stencil differs from the reference length of the image which is to be applied to the web of material 28. That situation may occur when the web of material is printed upon two or more times and the periods of time between the individual printing operations which are carried out in that way are so great that, between two consecutive passes through the printing machine, the length of the web of material alters.

In detail, that means that, in the event of the web of material 28 stretching in the longitudinal direction thereof, the individual printed image or image portions which have already been produced thereon undergo an increase in length which proportionally corresponds to the extent of the stretching of the web of material 28, with the result that that increase in length must be taken into account when applying the next image portion or image portions to the web of material, if it is to be provided that the contours of the individual printed image portion which is subsequently to be applied to the web of material 28 are in registry with the printed image or image portion which has already been produced on the web of material 28 in a preceding printing operation and which had been produced when the web of material 28 had been passed through the screen printing machine on a previous occasion. In order to adapt the further image which is to be applied to the web of material, to the printed image which is already to be found on the web of material 28 and which has experienced an increase in length by virtue of the web of material 28 having stretched in the meantime, the guide bars or rails 42 are pivoted out of their normal position somewhat in such a way that the angle 48 is increased. The result of that is that the parallel displacement of the screen printing stencil assembly 10 towards the right in the views shown in FIGS. 1 to 3 during the printing operation is correspondingly increased. That parallel displacement of the screen printing stencil assembly 10 is thus made up of the distance covered to compensate for the difference in length as represented by 30''- 30 in FIG. 3, which arises out of the angle of inclination 34, and an additional distance which serves to match the length of the image carried by the screen printing stencil to the length of the image on the web of material 28.

Conversely, in the event of shrinkage of the web of material 28 between two passes through the machine, the printed image which has already been applied to the material 28 in the earlier pass is reduced in length, with the result that the further printed image which is to be applied to the web of material in the further pass through the machine must be shorter than corresponds to the length indicated at 30'' of the image provided by the screen printing stencil 11. That effect is also achieved by suitable pivotal movement of the guide bars or rails 42 about the respective pivot axis 50, but in the opposite direction, that is to say in a direction which reduces the angle 48, so that the parallel displacement of the screen printing stencil assembly 10 during the printing operation becomes correspondingly shorter. In that case the extent of such parallel displacement corresponds to the difference between the distance for compensating for the difference in length of 30''- 30 arising out of the value of the angle 34, and the distance which serves to adapt the length of the image 30'' carried by the screen printing stencil to the length of the printed image on the web of material.

It will be appreciated that the extent by which the guide bars or rails 42 are pivoted out of their normal position is very slight. It will normally be of the order of magnitude of for example $\pm 1°$ to $3°$. However that is sufficient to provide the necessary adaptation of the length of the further printed image to be applied to the web of material 28, to the printed image which is already to be found on the material 28 and which has become longer or shorter by virtue of the variation in length of the web of material 28.

At any event, relative to the overall length of the printed image to be produced, the above-mentioned variations in length of the image to be applied to the web of material are so slight that the quality of the overall printed image which is made up of a plurality of individual printed image portions does not suffer as a result. However the above-indicated procedure and apparatus structure does in any event provide that the contours of the individual printed image portions are in registry to such a degree that they meet the requirements in respect of printed image quality.

The invention can also be used when the situation involves producing a printed image which is produced only in a single printing operation and is therefore not made up of a plurality of individual printed image portions. In that situation the invention makes it possible to take account from the outset of a subsequent variation in the length of the web of material, in such a way that a somewhat longer or shorter printed image than would correspond to the desired or reference position of the printed image is applied to the web of material by virtue of suitable adjustment of the screen printing stencil or the guide means therefor. In that case the extent by which the image applied to the web of material is longer or shorter than the reference length can correspond to the extent of the change in length that the web of material experiences at a later time, for example during a subsequent drying operation. Generally, in that situation the web will shrink and will thus become somewhat shorter so that the image to be applied to the web of material is somewhat longer than the reference length, more particularly depending on the extent of shrinkage of the web of material. It would theoretically also be possible instead to make the printed image carried by the screen printing stencil of a correspondingly longer length. However that would not take account of the fact that for example, in the event of a change in the material of the web to which the printed image is to be applied, the extent of the change in length which occurs, for example due to the above-mentioned heat treatment, will possibly alter. That can be taken into account by suitable adjustment of the screen printing stencil or the guide means therefor, but not by virtue of a change in the length of the image carried by the screen printing stencil.

In addition, in the case of multiple printing in which the finished printed image is made up of a plurality of individual printed image portions, it is possible for the first individual printed image portion to be applied in a correspondingly longer or shorter form, in accordance with the change in length experienced by the web of material in a first drying operation, by suitable adjustment of the screen printing stencil or the guide means therefor, in such a way that, after the length of the web of material has altered, the length of the first individual image portion substantially corresponds to the reference or desired length thereof. Then, on the assumption that thereafter there is no further substantial change in the length of the web of material, it is possible to apply a respective individual printed image portion whose length corresponds to the length which is laid down for the printed image on the web of material, without for that purpose necessitating substantial additional parallel displacement of the screen printing stencil during the printing operation. Such a mode of operation will be possible only when the nature of the web of material involved means that it experiences a substantial change in length for example in the first drying station and any additional changes in length which may occur, for example in subsequent drying stations, are noticeably less, and possibly are scarcely of any significance from a practical point of view. In that case it would also be theoretically possible for the printed image carried by the screen printing stencil for the first printing station to be made correspondingly longer. However that would give rise to the disadvantage that the image carried by that screen printing stencil would differ in length from the images carried by the screen printing stencils at the other printing stations. In terms of the production of the screen printing stencils, that would involve a considerable amount of complication and an increase in costs which can be satisfactorily avoided by using the process in accordance with the present invention.

It will be seen from the foregoing description that the process and apparatus in accordance with the principles of the invention are such that the web of material can be passed out of the printing mechanism at an acute angle relative to the screen printing stencil without requiring for that purpose a considerable amount of additional space for the web of material in the area beneath the stencil. Furthermore the web of material can be introduced into the printing mechanism of the machine in a simple fashion and without requiring special guide means for feeding the material to and along the screen printing stencil.

It will be appreciated that the above-described process and apparatus according to the invention have been set forth solely by way of example thereof and that various modifications and alterations may be made therein without thereby departing from the spirit and scope of the invention.

What is claimed is:

1. Apparatus for printing on material in web form by means of a screen printing process comprising at least one screen printing stencil carrying a print image, at least one squeegee, an impression cylinder co-operating therewith, means for movement of said impression cylinder during the operation of applying a printed image to the web of material relative to the screen printing stencil by a distance in the longitudinal direction of the web of material, means disposing the screen printing stencil at an acute angle relative to the path of movement of the impression cylinder so that there is a difference in length between said print image on the screen printing stencil and the projection thereof on to the path of movement of the impression cylinder, and a guide means for movement of the screen printing stencil during the printing operation relative to the impression cylinder substantially perpendicularly to the path of movement of the impression cylinder and with a longitudinal displacement parallel to the plane of the stencil, the extent of said longitudinal displacement corresponding to the difference in length between said print image on the screen printing stencil and the projection thereof on to the path of movement of the impression cylinder.

2. Apparatus as set forth in claim 1 wherein said guide means along which the screen printing stencil is guided during its movement substantially perpendicularly to the path of movement of the impression cylinder, for adapting the length of the printed image to be applied to the web of material to a predetermined length on the web of material is adjustable, in order thereby to adapt the extent of the parallel displacement of the screen printing stencil to the difference between the length of said print image on the screen printing stencil and the predetermined length on the web of material for the printed image to be applied thereto so that when such a difference occurs the length of said parallel displacement differs from the length which is involved when solely taking account of the difference in length between said print image on the screen printing stencil and the projection thereof on to the path of movement of the impression cylinder.

3. Apparatus as set forth in claim 2 wherein said guide means comprises at least one guide bar which in a normal position thereof includes relative to the vertical an angle which is substantially equal to half the angle by which the screen printing stencil is inclined relative to the path of movement of the impression cylinder roller, means for pivotal movement of said at least one guide bar in a plane which extends parallel to said path of movement of said impression cylinder and perpendicularly to the plane of the screen printing stencil, and for fixing said guide bar in a set position.

4. Apparatus as set forth in claim 3 wherein the screen printing stencil includes a frame structure and further comprising at least three rolling members carried by said frame structure and adapted to co-operate with said guide bar for guiding said screen printing stencil along said guide bar.

5. Apparatus as set forth in claim 4 wherein said frame structure carries extension portions thereon and wherein respective groups of three rolling members are carried on each extension portion and co-operate with respective ones of said guide bars.

6. Apparatus as set forth in claim 1 and further including a carriage, means supporting said carriage reciprocatingly slidably in the direction of printing, means mounting the impression cylinder rotatably on the carriage, and a sliding guide means mounting the stencil slidably on the carriage at an inclined angle relative to the line of movement of the carriage, said angle being equal to the angle at which the screen printing stencil is inclined relative to the path of movement of the cylinder.

* * * * *